US006637177B1

(12) United States Patent
Trillich et al.

(10) Patent No.: US 6,637,177 B1
(45) Date of Patent: Oct. 28, 2003

(54) APPARATUS AND METHODS FOR PRODUCING SEALED FLEXIBLE CONTAINERS INCLUDING A PRODUCT

(75) Inventors: Charles H. Trillich, Port Murray, NJ (US); Martin T. Jones, Easton, PA (US)

(73) Assignee: Packworld USA, Nazareth, PA (US)

( * ) Notice: Subject to any disclaimer, the term of this patent is extended or adjusted under 35 U.S.C. 154(b) by 85 days.

(21) Appl. No.: 09/595,212

(22) Filed: Jun. 16, 2000

(51) Int. Cl.[7] ..... B65B 31/00; B65B 63/02

(52) U.S. Cl. ..... 53/434; 53/436; 53/512; 53/526

(58) Field of Search ..... 53/434, 436, 512, 53/526, 479, 374.8, 374.9, 375.6

(56) References Cited

U.S. PATENT DOCUMENTS 2,496,609 A * 2/1950 Van Antwerpen ..... 53/526 X
2,925,719 A * 2/1960 Robbins et al. ..... 53/434 X
3,471,990 A * 10/1969 Bonuchi et al. ..... 53/526 X
3,516,217 A * 6/1970 Gildersleeve ..... 53/436 X
4,633,654 A 1/1987 Sato et al.
5,170,609 A 12/1992 Bullock et al.
5,603,284 A * 2/1997 Freedman ..... 53/436

FOREIGN PATENT DOCUMENTS

BE 565913 A1 * 7/1960 ..... 53/434

* cited by examiner

*Primary Examiner*—Stephen F. Gerrity
(74) *Attorney, Agent, or Firm*—Bell, Boyd & Lloyd LLC

(57) ABSTRACT

Apparatus and methods for removing excess fluid, and specifically gas, from a flexible container and sealing the container are provided. The apparatus comprises a device for receiving a flexible container including a product and having a first open end and a second sealed end located at an opposite end of the container from the first open end. The device includes an interior designed to receive at least a portion of the flexible container. The interior is defined, at least in part, by a compressible member that is so constructed and arranged so as to progressively squeeze excess gas located in the interior of the flexible container from the second sealed end out the first open end of the flexible container. The device also includes an integral sealing member that seals the first open end of the flexible container after the compressible member squeezes fluid from the interior of the flexible container.

4 Claims, 3 Drawing Sheets

APPARATUS AND METHODS FOR PRODUCING SEALED FLEXIBLE CONTAINERS INCLUDING A PRODUCT

BACKGROUND OF THE INVENTION

The present invention relates generally to apparatus for producing flexible containers containing products. More specifically, the present invention relates to devices for removing excess fluid from a flexible container and sealing same.

It is of course known to manufacture containers for housing products. One such type of container is a flexible container made from a flexible plastic material that is filled with a product and thereafter sealed. Such flexible containers can house a variety of solid or liquid products. Such products span a variety of industries and can include, for example, foodstuffs, cosmetics, and medical products and solutions.

There are also a variety of apparatus and methods for producing such flexible containers and placing products therein. One such apparatus is a form, fill, and seal packaging machine. Generally, in such machines, a web of flexible film is formed into a container or pouch. The container includes at least one open end. Through the open end of the container, a product is filled from the machine. The open end of the container is then sealed and a flexible container including product sealed therein is thereby produced.

There are a wide variety of such form, fill, and seal packaging machines. One example of such a machine is called a vertical form, fill, and seal packaging machine. However, it should be noted that the present invention is not limited to such an apparatus and a variety of packaging machines can be utilized with the present invention.

As noted above, typically, in a form, fill, and seal packaging machine, the process involves dispensing the product into an open end of a flexible container and thereafter sealing the open end of the container. If not extracted prior to the sealing process is complete, undesirable quantities of fluid, specifically air, will remain within the container after the open end has been sealed. This excess fluid (air) can create a number of issues.

For example, the presence of excess air in the flexible container provides an oxidizing environment. This environment can be detrimental to the contents that are packaged in the flexible container. Moreover, typically, ambient air contains moisture. Such moisture can be detrimental to the contents of the flexible container and can act as a corrosive.

Additionally, the presence of air in the flexible container also creates issues aside from contaminating or adversely impacting the contents of the container. Flexible containers having an excess amount of air will become inflated and may burst when the container is subjected to a low-pressure environment such as high altitude. Moreover, excess air can occupy a substantial portion of the volume of the flexible container thereby occupying a substantial volume of any shipping crate, case, or carton in which the containers are packaged and/or transported. This can create a number of issues. For example, the excess air may bleed out of the filled flexible containers, creating an unoccupied volume within the shipping case. When this occurs, the flexible containers are no longer supported within the shipping carton and therefore freely move about, which movement can damage the flexible containers and the products housed therein. Further, the excess air in the flexible container occupies space, reducing the number of containers that can be packaged in a specific shipping carton. This thereby increases shipping and transportation costs.

As noted above, these flexible containers can house a variety of products including medical solutions and products. It is known in the medical industry to sterilize such medical products and/or solutions by sterilizing the flexible container and the product at the same time. For example, it is known to sterilize such flexible containers using gas, such as by use of ETO sterilization. Flexible containers will more readily accept the gas for such sterilization if they are evacuated and do not include excess air.

It is therefore known to attempt to remove excess air from the flexible container prior to sealing the container. One such prior art attempt to remove excess air has been to use a vacuum. The use of a vacuum is designed to withdraw air from the flexible container prior to sealing the container. Generally, such methods include lightly holding the flexible container between two members. A nozzle is then inserted in the open end of the flexible container prior to sealing the container. The nozzle evacuates the fluid contents from the flexible container. The nozzle is then withdrawn and the end of the flexible container is sealed.

This method has not been entirely satisfactory. One of the problems with a method that uses a vacuum is that it is slow. Further, the nozzle can become "blinded" by the side walls or bottom of the flexible container or even the contents of the container. This thereby obstructs the flow of fluid (air) from the container, resulting in an incomplete evacuation of the excess fluid from the flexible container.

Accordingly, alternative methods have been attempted to remove the excess air from the flexible container. One such method is to squeeze the flexible container from the outside by using an apparatus that contacts the sides of the container. However, the inventors do not believe that such methods provide a safe and convenient means for removing the excess fluid. For example, numerous issues exist with respect to presenting the flexible container to a sealing member, for sealing the opening, after expelling the air. Further, such known apparatus and methods do not effectively compress the flexible container in and around irregular configurations that certain flexible containers may exhibit due to their design and/or contents. Further, such known methods are time consuming.

Accordingly, there is a need for an improved method for expelling excess fluid from a flexible container and sealing the flexible container, in, for example, a form, fill, and seal packaging machine.

SUMMARY OF THE INVENTION

The present invention provides improved apparatus and methods for removing excess fluid, and specifically gas, from a flexible container and sealing the container. Additionally, the present invention provides improved methods and apparatus for producing flexible containers, in, for example, form, fill, and seal packaging machines.

To this end, in an embodiment, an apparatus for producing sealed flexible containers housing a product is provided. The apparatus comprises a device for receiving a flexible container including a product and having a first open end and a second sealed end located at an opposite end of the container from the first open end. The device includes an interior designed to receive at least a portion of the flexible container. The interior is defined, at least in part, by a compressible member that is so constructed and arranged so as to progressively squeeze excess gas located in the interior of the flexible container from the second sealed end out the first open end of the flexible container. The device also includes an integral sealing member that seals the first open end of the flexible container after the compressible member squeezes fluid from the interior of the flexible container.

In an embodiment, the compressible member includes at least one fluid filled member.

In an embodiment, the fluid filled member is a pillow filled with air.

In an embodiment, the fluid filled member is coupled to a source for filling the member with fluid.

In an embodiment, the compressible member includes at least one removable rubber foam insert.

In an embodiment, the sealing member includes a heat seal bar.

In an embodiment, the device includes two halves that are hinged together, each half including a compressible member, and each of the compressible members contacts and squeezes fluid out of the flexible container located in the interior as the halves are moved toward each other.

In an embodiment, the apparatus is a form, fill, and seal packaging machine.

In a further embodiment of the present invention, a device for removing fluid from a flexible container and sealing same is provided. The device comprises a body including first and second members that define therebetween an interior. Each of the first and second members includes a compressible member, the compressible member being so constructed and arranged as to compress-a flexible container located in the interior from a first end progressively toward a second end of the flexible container located within the interior. The device also includes a sealing member that is designed to seal an end of the flexible container located within the interior as the two members are urged together.

In an embodiment, the compressible members include an interior that is designed to be at least partially filled with a fluid.

In an embodiment, the compressible members include, at least in part, removable foam inserts.

In an embodiment, the first and second member are hinged together at one end thereof.

In an embodiment, the sealing member is a heat-seal bar.

In an embodiment, each of the compressible members includes a removable foam insert and a fluid-filled pillow, the fluid-filled pillow being designed to contact the flexible container located within the interior.

In an embodiment, the first and second members are hinged together so that each of the members can move toward the other member.

In an embodiment, the second member is fixed and the first member moves toward the second member.

In an embodiment, the interior of the device defines a structure that receives and supports the flexible container in a vertical orientation.

In yet a further embodiment of the present invention, a method for producing a sealed flexible container housing a product is provided. The method comprises the steps of: positioning within an interior of a device having a first and second member, a flexible container housing a product, the container having a sealed first end and an open second end; causing at least one of the first or second members to move towards the other member and causing interior walls of the members to compress the flexible container from the first end thereof expelling gas from the second end thereof; causing the first and second members to be urged together; and as the first and second members are urged together, sealing the second end of the container to create a sealed container.

In an embodiment, the method includes the step of varying the volume of empty space defined by the interior of the first and second member.

In an embodiment, the method comprises the steps of dropping a sealed flexible container on to a conveyor belt.

In an embodiment, the method comprises the steps of removing the sealed flexible container from the interior of the device by lifting it vertically.

Accordingly, it is an advantage of the present invention to provide an improved device for expelling at least a portion of the excess air from a flexible container and sealing the container.

Additionally, an advantage of the present invention is to provide improved methods for producing flexible containers housing a product.

Another advantage of the present invention is to provide improved form, fill, and seal packaging machines.

Still further, an advantage of the present invention is to provide an improved method for expelling excess gas/fluid from a flexible container.

Moreover, an advantage of the present invention is to provide a device that will remove excess fluid from a flexible container and seal same that can be used in a variety of packaging machines.

Additional features and advantages of the present invention will be described in and apparent from the detailed description of the presently preferred embodiments and the figures.

DETAILED DESCRIPTION OF THE PRESENTLY PREFERRED EMBODIMENTS

The present invention provides methods and devices for producing flexible containers for housing products. Specifically, the present invention is directed to devices and methods for expelling fluid, specifically gas, from a flexible container and sealing the container. Although in a preferred embodiment, the device is designed to be utilized in a form, fill, and seal packaging machine, the device can be used in any machine for producing flexible containers for housing products.

Pursuant to the structure of the device of the present invention, a number of advantages are achieved. The device allows the entire opening (mouth) of the flexible container to be open during the process for expelling the excess gas. This allows for the rapid expulsion of air prior to sealing the flexible container. This is in contrast to many prior art devices wherein only a portion of the mouth, or opening, of the flexible container is open during the fluid expulsion; increasing the time necessary to expel the fluid and creating other issues, such as possible product damage and incomplete sealing of the flexible container.

Additionally, pursuant to the present invention, the flexible container is deflated progressively from the sealed end toward the open end. This facilitates the expulsion of gas with minimal disruption and damage to the product contained within the flexible container. This is in contrast to prior art methods wherein the entire flexible container is subjected to a force at the same time causing the gas to be urged in a number of directions, not necessarily out of the mouth of the container.

As set forth in detail below, the sealing means is an integral part of the device for expelling gas. Therefore, the deflation force (the force that causes the gas to be expelled from the flexible container) also acts as the sealing force. This has a number of advantages including ensuring that the flexible container is only sealed after the container is completely evacuated of the excess gas.

Another advantage of the device is that it is easily adjustable for differing sized flexible containers. For example, as set forth in detail below, in an embodiment, foam inserts are utilized that can be removed or added to the device to accommodate different sized flexible containers. Further, as discussed below, in a preferred embodiment of the invention the compression member includes air-filled pillows. These pillows can be inflated or deflated to provide varying degrees of compression depending on the nature of the contents of the flexible container and the size of the container. Another advantage of the structure of the present invention is that is does not require inflation and deflation between sealing cycles.

Figure 1:
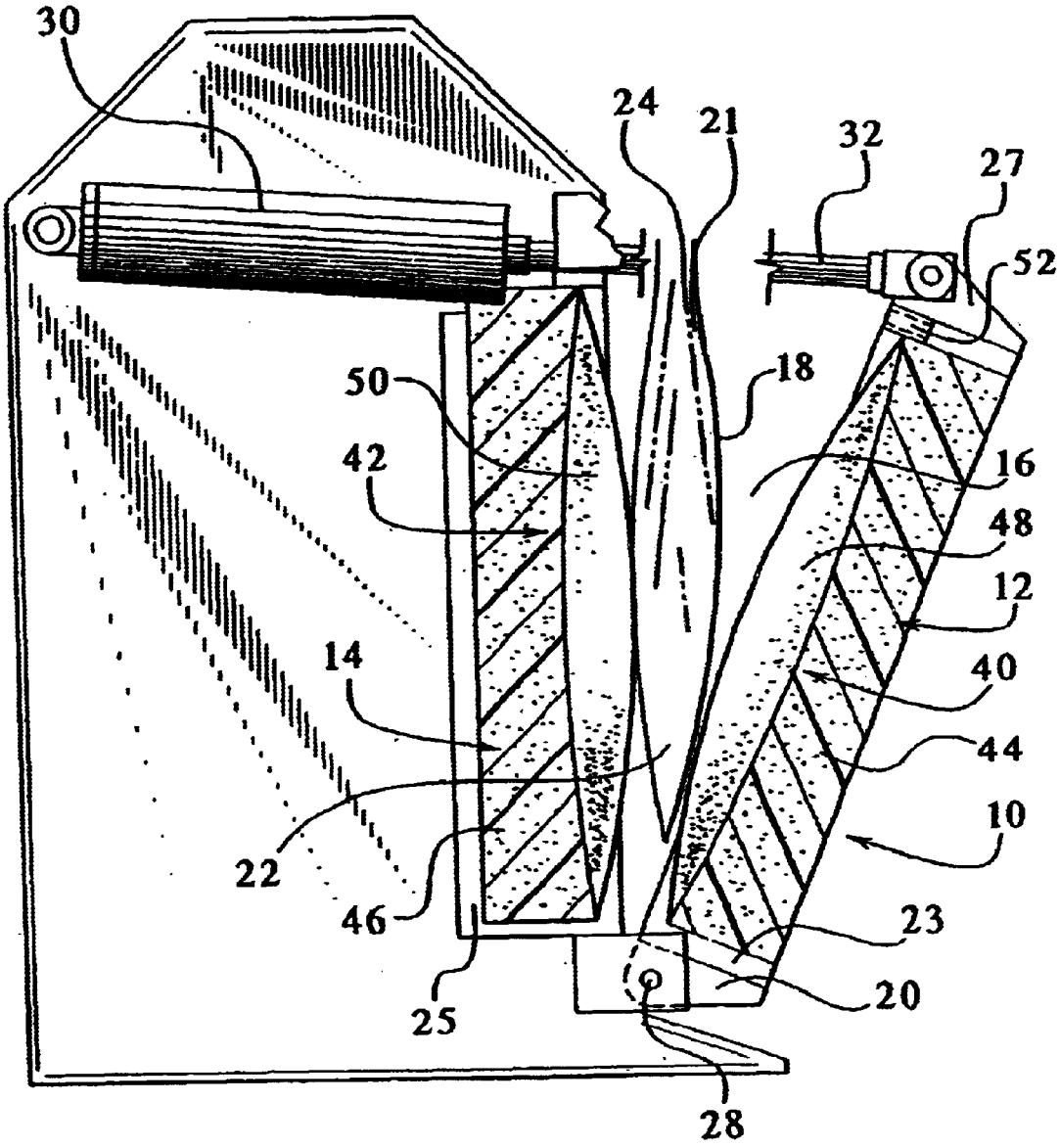
FIG. 1 illustrates a perspective view of an embodiment of the device of the present invention in a load/unload position.
Figure 2:
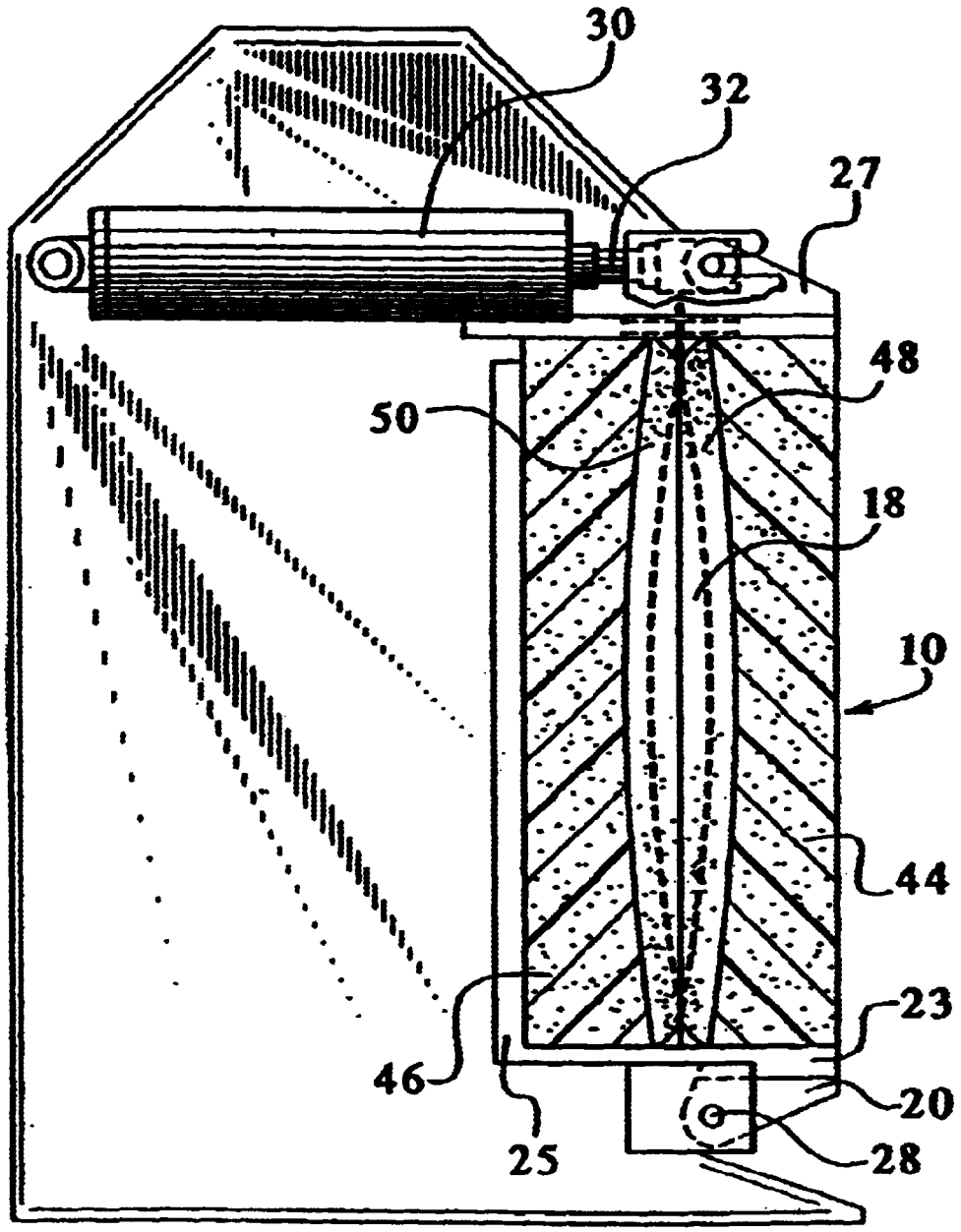
FIG. 2 illustrates a perspective view of the embodiment of the device of FIG. 1 in a closed position.

Referring now to FIGS. 1 and 2, an embodiment of the device 10 is illustrated. In the preferred embodiment illustrated, the device 10 includes two complementary halves defined by a first member and a second member 12 and 14. The first and second members 12 and 14 define an interior 16 for receiving a container 18. In the preferred embodiment illustrated, the first member is hinged at an end 20 allowing portions of the first member 12 to pivot toward and away from portions of the second member 14. However, it is not necessary for the first and second members 12 and 14 to be hinged together, what is required is to allow the halves to be able to be urged together causing excess gas contained in an interior 21 of the container 18 to be expelled therefrom progressively from a bottom 22 of the container 18 through a top open end 24 of the container. It should also be noted, that it is not necessary for the interior 16 to receive the container 18 in a vertical orientation, but if desired, the container can be oriented between the halves 12 and 14 horizontally.

In a preferred embodiment, the first and second members 12 and 14 including body members 23 and 25 respectively that are constructed from stainless steel. However, the body members 23 and 25 and the first and second members 12 and 14 can be constructed from any material. As illustrated in the preferred embodiment illustrated, the first member 12 is coupled to at least one cylinder 30 including an arm 32, e.g., a manually hydraulic/pneumatic cylinder or motor driven crank/cams at a top end 27 thereof. Therefore, when extended the arm 32 urges the first member 12, and specifically the top end 27 thereof, away from the second member 14; in this regard, end 20 is fixed and pivots about a hinge 28. This allows access to the interior 16 of the device 10.

Located within each of the first and second member 12 and 14 is a compressible member 40 and 42 respectively. In the preferred embodiment illustrated, the compressible members 40 and 42 comprise a foam insert 44 and 46 respectively and an inflatable pillow 48 and 50 respectively. However, if desired, it is possible to use only the foam inserts 44 and 46 or inflatable pillows 48 and 50 as the compressible members 40 and 42.

By using both the foam inserts 44 and 46 and inflatable pillows 48 and 50, a variety of advantages can be achieved. For example, the foam inserts 44 and 46 are designed to be removable so that they can be replaced with larger or smaller foam inserts allowing the interior 16 of the device 10 defined by the first and second member 12 and 14 to be varied. To this end, by using a foam insert having a greater width this will reduce the resultant open area dimensions of the interior 16 when the first and second member 12 and 14 are closed, as compared to foam inserts having a smaller width. This allows differing sized packages to be received within the device 10 and gas (air) to be expelled from same. In another embodiment, the density of the foam material is varied to allow one to vary the size of the interior 16 of the device 10.

Additionally, the foam inserts 44 and 46 can have a variety of cross-sectional shapes and designs. For example the foam inserts 44 and 46 can include cut out portions. For example, the foam inserts 44 and 46 can include an arcuate cutout for receiving a portion of the inflatable pillows 48 and 50.

Referring now to the inflatable pillow members 48 and 50, they can be a variety of type structures. In an embodiment, the pillows are constructed from polyurethane inflated with air. The inflatable pillow members 48 and 50 either can be coupled to a pressurized air pump member (not shown) or can be pre-filled and not coupled to an air member. In either event, these air-filled pillows 48 and 50 can be adjusted so that they will either create an interior, when the first and second member are closed, having more or less space. This allows the compressible members 40 and 42 to be adjusted to accommodate varying sized containers 18, containers 18 including varying sized products, or containers 18 that may be filled with more or less products than other containers.

In an embodiment, the air-filled pillows are inflated to approximately 1 to about 1.5 psig. This has been found to allow the compression and removal of excess air from container including even delicate products without damage to the contents. To this end, tests were successfully conducted with a raw egg as the contents.

It is possible to provide a wide variety of shapes to the interior 16 of the device 10 for compression of a container located therein. Ideally, the interior, when the first and second member 12 and 14 are closed, more or less conforms to the cross-sectional shape of the container including product but not excess gas.

In use, a flexible container 18 is placed in the interior 16 of the device 10. The flexible container 18 can be positioned in the interior 16 of the device through a variety of methods. For example, the flexible container 18 can be created and filled above the interior 16, as is known in form, fill, and seal packaging machines, and dropped or placed therein. In an embodiment, an arm or other clamping member can place the container 18 in the interior 16. What is important is that the container 18 is positioned with the open end to be sealed extending through a top portion of the interior 16. The open end 24 of the container 18 extends by sufficient length to facilitate holding, either by an operator's hands, or a clamping device.

As the first member 12 is urged toward the second member 14, the compressible member 40 and 42 contact the container 18. Due to the force of the compression means 40 and 42 gas is progressively forced up and out of the opening 24 of the container 18. As the first member 40 continues to move toward the second member 42, a sealing member 52 contacts and seals the top end 24 of the container 18. In this regard, in an embodiment the sealing member 52 is actuated prior to complete closure of the device 10. The sealing member 52 can be a variety of sealing means used in the art and in an embodiment is a heat seal bar.

When the expelling and sealing process is complete, the flexible container 18 can then be removed e.g., a clamping member (not shown) that can transport and move the container by gripping and holding the sides thereof. As noted below, in an embodiment, the sealed container 18 can be dropped to a conveyor belt.

Figure 3:
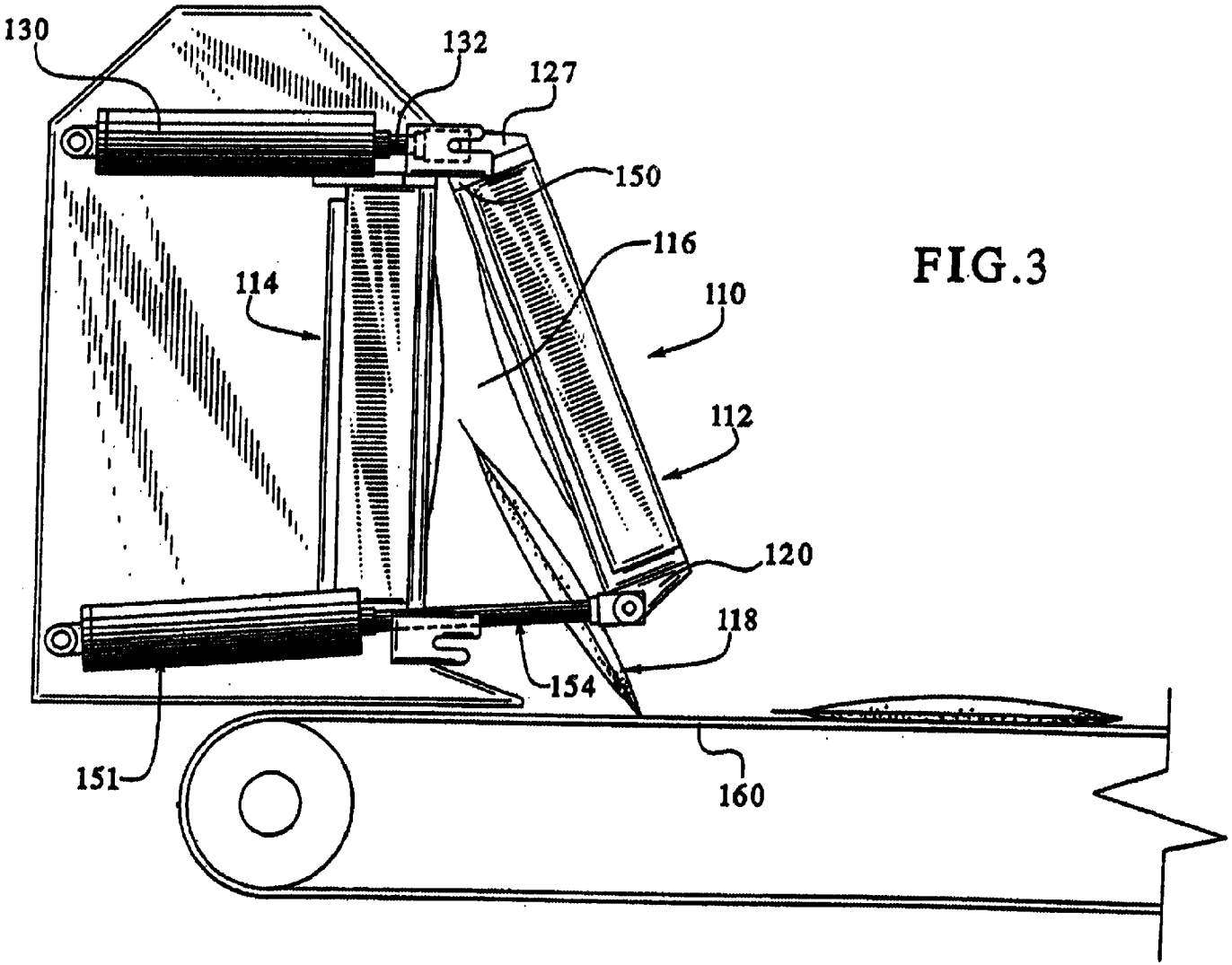
FIG. 3 illustrates another embodiment of the device of the present invention in the unload position.

Referring now to FIG. 3 another embodiment of the device 100 of the present invention is illustrated. This embodiment is similar to the previous device 10. To this end, a flexible container 118 is loaded into the interior 116 of the device 110. As the device 110 closes, gas is progressively expelled from the bottom of the container 118 through the top end of the container. Once the first and second member 112 and 114 of the container are in juxtaposition at a top end thereof, the sealing member 150 contacts as in the previous embodiment. At this time the sealing member 150 can be energized to seal the end of the container 118. The container 118 thus sealed has had at least a portion of the excess gas expelled.

However, in this embodiment, the first member 112 is also pivotally connected at a top end 127 to the second member 114. The device 110 includes a second cylinder 151 and arm 154. This allows the device 110 to open at a bottom end 120 allowing a container 118 to be dropped therefrom. In the preferred embodiment illustrated, the container 118 is dropped onto a conveyor belt 160. This allows the sealed container 118 to be transported to a packaging area. This embodiment also allows for the consecutive loading of the device 110, e.g., top to bottom, as in a vertical form, fill, seal packaging machine.

A still further embodiment of the device, not illustrated, is to orient the compression members more or less parallel to each other. This would provide a wider opening, as compared to a hinged structure, for accommodating larger containers. Side loading would also facilitate the use of a horizontal conveyor from which containers could be carried into and out of the interior of the device, facilitating production.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

We claim:

1. An apparatus for creating sealed flexible containers housing a product comprising:

a device for receiving a flexible container including a product and having a first open end and a second sealed end located at an opposite end of the flexible container from the first open end, the device including an interior designed to receive at least a portion of the flexible container, the interior being defined, at least in part, by a compressible member that is so constructed and arranged so as to progressively squeeze gas in the container from the second sealed end out the first open end, and the device including an integral sealing member that seals the opening of the container after the compressible member squeezes fluid from the interior of the container;

wherein said device includes two halves that are hinged together, each half including a compressible member, where the compressible members contact and squeeze gas out of the flexible container located in the interior as one of said halves is moved toward the other halve; and wherein said halves each include a top end and a bottom end, and one halve can pivot toward or away from the other halve at each of said top and bottom ends.

2. A device for removing fluid from a flexible container and sealing same comprising:

a body including first and second members, that define therebetween an interior;

each of the first and second members including a compressible member, the compressible members being so constructed and arranged as to compress a flexible container located in the interior from a first end progressively toward a second end of the flexible container located within the interior; and a sealing member that is designed to seal an end of the flexible container placed within the interior after the two members are urged together;

wherein each of said compressible members includes a removable foam insert and a fluid-filled pillow, said fluid-filled pillow being designed to contact a flexible container located therein.

3. A device for removing fluid from a flexible container and sealing same comprising:

a body including first and second members, that define therebetween an interior;

each of the first and second members including a compressible member, the compressible members being so constructed and arranged as to compress a flexible container located in the interior from a first end progressively toward a second end of the flexible container located within the interior; and a sealing member that is designed to seal an end of the flexible container placed within the interior after the two members are urged together;

wherein said device includes two cylinders and two arms, one of the arms being connected to a top end of the first member and a second arm connected to the bottom end of the first member.

4. A method for producing a sealed flexible container housing a product comprising the steps of:

positioning a flexible container housing a product and having a sealed first end and an open second end, within an interior of a device having first and second members, the interior being defined at least in part by compressible members of the first and second members, where said compressible members include an inflatable member and a foam insert;

causing at least one of the first or second members to move towards the other member and causing the compressible members to compress the flexible container from the first end thereof expelling gas from the second end thereof;

causing the first and second members to move together; and when the first and second members have moved sufficiently close together sealing the second end of the container to create a sealed container.

* * * * *